United States Patent [19]

Heard

[11] 4,094,487

[45] June 13, 1978

[54] SECURING DEVICE

[76] Inventor: Robert Arthur Henderson Heard, Church Farm, 63 Church Lane, Backwell, Bristol, England

[21] Appl. No.: 695,411

[22] Filed: Jun. 14, 1976

[30] Foreign Application Priority Data

Jun. 16, 1975 United Kingdom ..... 25618/75

[51] Int. Cl.[2] ..... E01F 9/01

[52] U.S. Cl. ..... 248/231; 40/607

[58] Field of Search ..... 248/62, 73, 74 R, 74 B, 248/70, 230, 231, 499, 218.4; 24/265 CD, 265 R; 52/38; 40/125 H; 105/369 A

[56] References Cited

U.S. PATENT DOCUMENTS

| | | | |
|---|---|---|---|
| 2,347,113 | 4/1944 | King | 248/62 |
| 3,226,069 | 12/1965 | Clarke | 248/73 |
| 3,894,707 | 7/1975 | Heard | 248/231 |

FOREIGN PATENT DOCUMENTS

| | | | |
|---|---|---|---|
| 1,318,927 | 3/1962 | France | 40/606 |
| 1,524,213 | 4/1968 | France | 248/74 R |
| 1,054,293 | 4/1959 | Germany | 248/73 |
| 56,873 | 12/1942 | Netherlands | 248/73 |

*Primary Examiner*—J. Franklin Foss

*Attorney, Agent, or Firm*—Larson, Taylor and Hinds

[57] ABSTRACT

A body having a channel with inturned lips is mounted to a post by a strap which is tightened around the post. The strap is connected by attachment means to the end portions of an elongate plate which is slid lengthwise into the channel and engages behind the lips to be thereby retained in the channel. Tightening of the strap urges the plate against the lips and secures the mounting device in position. One attachment member has a body part slotted to receive the strap, and a stem part secured to the elongate plate. The other attachment member is L-shaped, providing one limb which is slotted to receive the strap and another limb which is connected adjustably to the elongate plate by a nut and bolt.

5 Claims, 1 Drawing Figure

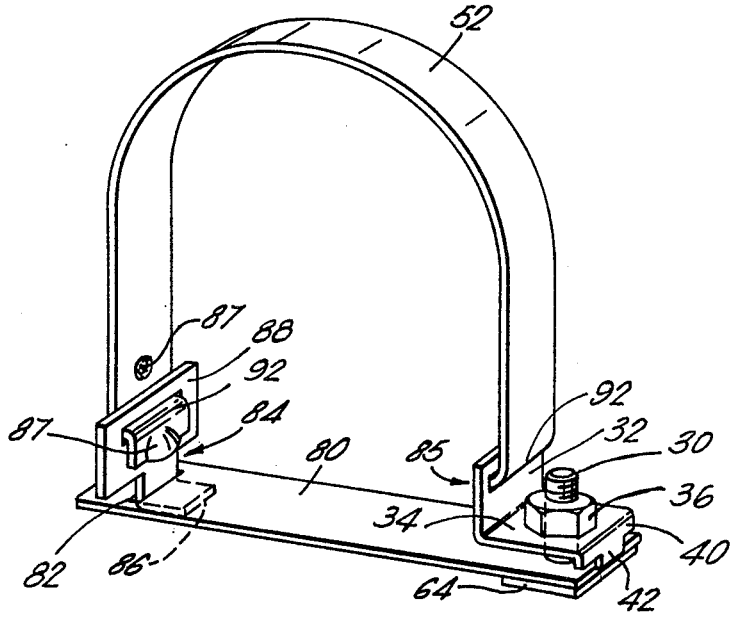
52
87
88
92
84
87
80
85
92
32
30
36
34
40
82
86
64
42

SECURING DEVICE

FIELD OF THE INVENTION

This invention relates to securing devices, and more particularly to a device for securing a first body, such as a post, to a second body such as a sign, the second body comprising a channel member having a restricted mouth.

BACKGROUND TO THE INVENTION

Various strap like devices are known for mounting a body to a channel having a restricted mouth. One problem is to provide suitable attachment members for connecting the strap to the channel. Such attachment members are conveniently and cheaply made from sheet steel, but with soft aluminium channels the thin sheet can cut into the aluminium. Also conventional attachment members are usually not easily adaptable to different sizes of channel. Another problem is coping with a wide variety of different size and shape bodies to be fixed to the channel. Yet another problem is that of providing adequate strength in the mounting and reducing the risk of accidental, or even deliberate but unauthorised, detachment of the device from the channel.

SUMMARY OF THE INVENTION

According to the present invention there is provided a device for securing a first body to a second body, the second body comprising a channel member having a restricted mouth, the device comprising an elongate member for insertion lengthwise into the channel to extend across its mouth and be retained in the channel by the inturned lips thereof, a pair of attachment members connected or arranged for connection to the elongate member through the mouth of the channel and connected or arranged for connection to a strap to be passed around the first body. One of the attachment members is connected or connectable with the elongate member by means of a screw-threaded bolt the shank of which passes through an opening in the elongate member to project from the channel mouth and through an opening in its respective attachment member, the head of the bolt being retained within the channel by engagement with the elongate member and a nut adjustably securing the shank of the bolt to the attachment member. The other attachment member has a body slotted to receive the strap and a stem to pass through the channel mouth and connected to the elongate plate.

In order that the invention may be more clearly understood, one embodiment will now be described with reference to the accompanying drawing.

The drawing shows a perspective view of one embodiment of attachment device.

The device is suitable for use in securing a sign to a supporting post of circular cross-section, the sign carrying one or more channel members on its rear surface, the mouth of the channel opening away from the rear face of the sign and being restricted by inturned lips.

Referring to the drawing, the secured device comprises a stainless steel strap 52, formed into a U-shape for passing around a circular section supporting post. The ends of the strap are cranked and engage in slots in respective attachment members 84,85. The attachment member 84 is a T-shaped stainless steel plate, providing a body 88 and a stem 86. The body is slotted to receive the respective cranked end 92 of the strap 52. The end portion of the stem 86 passes through a slot 82 in one end portion of an elongate plate 80 and is bent through 90° and is spot-welded to the underside of the plate. The attachment member 85 comprises an L-shaped stainless steel sheet part providing two limbs, one limb 32 being slotted to receive the respective cranked end 92 of the strap 52, the other limb 34 being turned away from the attachment member 84. The screwthreaded shank 30 of a bolt passes through an aperture in the adjacent end portion of the plate 80 and an aperture in the limb 34. The head 64 of the bolt is welded to the underside of the plate 80 to prevent rotation. This prevents the bolt from becoming accidentally disengaged from the plate prior to assembly of the device. A nut 36 adjustably retains the limb 34 on the bolt. Blips 87 are formed in the strap on either side of the crank engaging the attachment member 84, to prevent or resist withdrawal of the strap, while permitting hinging of the strap relative to the attachment member. At the other end, the strap can be similarly retained to the attachment member 85, but it could instead be secured by spot-welding. The free end of the limb 34 is down-turned towards the plate 80 to provide a rib 40. In the center of the rib 40 is an extension tab 42.

The attachment member 85, instead of being separate from the strap 52, could be formed integrally with the strap by turning the end of the strap outwardly to provide the limb 34.

In use, the device is offered up to the end of the channel member on the rear of the sign, and the elongate plate 80 is slid lengthwise into the channel. The nut 36 is removed and the strap is hinged about the attachment member 84 so that it can be passed around the post. The limb 34 is then replaced on the shank of the bolt, and the nut is re-attached and screwed down to tighten the strap around the post. The tab 42 can enter the mouth of the channel and the rib 40 can bear upon the channel member on either side of the mouth. The stem 86 of the attachment member 84 and the shank 30 of the bolt extend through the channel mouth, and the plate 80 bears against the underside of the channel lips.

Although the invention has been referred to as a device for mounting a sign to a post, it will be apparent that it can be used more generally for attaching other articles, such as cables or pipes, to a channel member with a restricted mouth.

I claim:

1. A device for securing a first body to a second body, the second body comprising a channel member having a mouth restricted by inturned lips, the device comprising an elongate plate for insertion lengthwise into the channel to extend across its mouth and be retained in the channel by the inturned lips thereof, a pair of attachment members arranged for connection to the elongate member through the mouth of the channel and connected or arranged for connection to a strap to be passed around the first body, one of the attachment members comprising a flat body part slotted to receive said strap and a narrower stem part to extend through the channel mouth and being connected at its end remote from the body part to an end portion of the elongate plate, the other attachment member being of L-shaped configuration comprising a first limb connected or arranged for connection to said strap and a second limb at right angles thereto with an aperture therein, a nut and bolt adjustably connecting said second limb with the adjacent end portion of the elongate plate so that the shank of the bolt extends through the channel mouth, the shank of the bolt passing through an aperture in the elongate plate and the aperture in said second limb, the head of the bolt lying on the side of the elongate plate remote from said second limb and the nut being carried on the shank on the side of said second limb remote from the elongate plate.

2. A securing device according to claim 1 wherein the second attachment member is formed separately from the strap and said first limb of the second attachment member is slotted to receive said strap.

3. A device for securing a first body to a second body, the second body comprising a channel member having a mouth restricted by inturned lips, the device comprising in combination:

(i) an elongate sheet metal plate for insertion lengthwise into the channel to extend across its mouth and be retained therein by the inturned lips thereof;

(ii) a sheet metal strap for passing around the first body and being cranked at its opposite ends;

(iii) a first sheet metal attachment member having a body part which is slotted to receive one cranked end of the strap, and a stem part narrower than the channel mouth extending in the direction away from the strap, the end portion of the stem part passing through a slot in the adjacent end portion of the elongate plate and turned through 90° and secured to the surface of the elongate plate remote from said body part; and (iv) a second attachment member having an L-shaped sheet metal part providing two limbs, a first limb being slotted to receive the other cranked end of the strap, the second limb being directed away from said first attachment member, and a nut and bolt adjustably connecting said second limb and the adjacent end portion of the elongate plate, the shank of the nut being narrower than the channel mouth and passing through apertures in the elongate plate and said second limb, the head of the bolt being secured to the surface of the elongate plate remote from said second limb, the nut being carried on the shank on the side of said second limb remote from the elongate plate.

4. A device according to claim 3 wherein the end portion of said second limb is turned towards the elongate plate to provide a rib for bearing on the channel member on each side of the mouth thereof.

5. A device according to claim 4 wherein the central portion of said rib is provided with an extension tab for engaging in the channel mouth.

* * * * *